US010588362B1

(12) United States Patent
Alexei

(10) Patent No.: US 10,588,362 B1
(45) Date of Patent: Mar. 17, 2020

(54) GARMENT CONVERTIBLE TO SHOULDER BAG

(71) Applicant: Doina Alexei, Fairfax, VA (US)

(72) Inventor: Doina Alexei, Fairfax, VA (US)

( * ) Notice: Subject to any disclaimer, the term of this patent is extended or adjusted under 35 U.S.C. 154(b) by 78 days.

(21) Appl. No.: 15/672,329

(22) Filed: Aug. 9, 2017

Related U.S. Application Data

(60) Provisional application No. 62/494,639, filed on Aug. 11, 2016.

(51) Int. Cl.

| | |
|---|---|
| ***A41D 15/00*** | (2006.01) |
| ***A41D 15/04*** | (2006.01) |
| ***A41D 27/24*** | (2006.01) |
| ***A41D 3/00*** | (2006.01) |
| ***A45C 9/00*** | (2006.01) |
| ***A45C 3/06*** | (2006.01) |

(52) U.S. Cl.
CPC ..... *A41D 15/04* (2013.01); *A41D 3/00* (2013.01); *A41D 27/24* (2013.01); *A45C 3/06* (2013.01); *A45C 9/00* (2013.01); *A41D 2300/322* (2013.01); *A41D 2300/50* (2013.01); *A41D 2400/48* (2013.01)

(58) Field of Classification Search
CPC ..... A41D 15/04; A41D 3/00; A41D 27/24; A41D 2300/322; A41D 2300/50; A41D 2400/48; A45C 3/06; A45C 9/00
See application file for complete search history.

(56) References Cited

U.S. PATENT DOCUMENTS

| | | | | |
|---|---|---|---|---|
| 4,315,334 A * | 2/1982 | Pearsall | A41D 3/02 2/85 |
| 4,575,876 A * | 3/1986 | Weaver | A47G 9/086 2/69.5 |
| 5,996,121 A * | 12/1999 | Harris | A41D 15/04 2/108 |
| 7,647,656 B2 * | 1/2010 | Smith | A41D 15/04 5/413 AM |
| 2010/0111448 A1 * | 5/2010 | Li | A41D 15/04 383/4 |
| 2016/0157535 A1 * | 6/2016 | Tirro | A41D 1/02 2/93 |
| 2018/0199647 A1 * | 7/2018 | Kennedy | A41D 27/20 |

* cited by examiner

*Primary Examiner* — Steven O Douglas

(57) ABSTRACT

One embodiment of a garment convertible to shoulder bag of the type comprising two separating zippers extending in an open fashion vertically along each side of the garment such as to form the bag compartment when the garment is folded and zipped at the sides. The garment further comprising an upper back panel (48) connected to the garment at the back neckline (42), shoulders (12) and back armholes (44). A stitch is applied horizontally through the upper back panel (48) and the garment upper back (52) and through a set of D-rings (66) and a reinforcement strap (68) positioned in between. The horizontal back panel stitch (46) allows for the formation of a straight bag opening edge (76) when the panel is flipped over the neckline towards the garment's front. A removable bag strap (32) is housed within loops on the inside of the garment and the garment's hem is elongated such as to form the bag closing flap (80).

13 Claims, 4 Drawing Sheets

GARMENT CONVERTIBLE TO SHOULDER BAG

CROSS-REFERENCE TO RELATED APPLICATIONS

This application claims the benefit of provisional patent application Ser. No. 62/494,639, filed Aug. 11, 2016 by the present inventor.

PRIOR ART

The following is a list of some prior art that appears to be relevant presently:

| U.S. Pats. | | |
|---|---|---|
| Pat. No. | Issue Date | Patentee |
| 4,055,853 | 1977 Jan. 11 | Argento, Strandt |
| 4,307,470 | 1981 Dec. 29 | Ezell |
| 5,996,121 | 1999 Dec. 7 | Harris |
| 5,850,634 | 1998 Dec. 22 | Toombs |
| 4,315,334 | 1982 Feb. 16 | Pearsall |

BACKGROUND

The present disclosure relates to a garment convertible to bag. Specifically, an outer garment convertible to shoulder bag. It provides the user the advantage of wearing the garment as a conventional jacket designed to further convert into a functional bag with little indication that either item is of the convertible type.

Conventional outer garments provide warmth when needed but they do not address the issue of dealing with changing temperatures and circumstances throughout the day. When the weather becomes warmer, outerwear garments such as jackets have to be hand-carried without providing any additional function. When having to do so, users may often feel discomfort especially when supplementary items are also to be carried. In addition, changing events and circumstances throughout the day provide further hassle when having to sustain a garment that is not in functional use.

Several convertible garments have been proposed to address these issues. However, most inventions focus on ease of carrying or convenient storage during travel. This is done either by options of incorporation into a self-contained pouch or a folding apparatus to create a portable circumstance. However, this does not address the issue of providing additional function when the garment is in its converted form. One must still carry the converted garment as an additional item without any added functional use.

Many garments that are convertible to a functional bag are limited by the use of pockets to house additional items. Nevertheless, these pockets do not offer enough space or long-term durability. Argento, Strandt and Harris propose outerwear garments that when converted to a bag, provide the use of the garment's pockets as a device to carry additional items. This not only limits the space availability for larger items but it also creates a structural issue in the design. The pockets on both sides have to be filled by items of approximately the same weight in order to maintain the structural balance of the converted bag. If one pocket is filled with significantly heavier matter, it will pull the side of the bag down rendering the bag structure increasingly difficult to use.

Several inventions that use the body of the garment to form the carrying container for the bag have been proposed. However, they feature visible hardware on the outside of the garment which further separates it from a conventional garment. Gazzola discloses a jacket-to-bag conversion that includes exposed zip fasteners along the shoulders, side areas and lower portion of the jacket creating visibly bulky seams along each edge. In addition to jeopardizing comfort, the hardware provides an aesthetic style disadvantage thus making the user more hesitant to wear it. Ezell suggests a jacket convertible to backpack that includes visible straps and a set of exposed D-rings on the back portion of the garment. The exposed hardware not only makes the jacket less aesthetically pleasing, it also limits its usability to outdoor activities or only settings appropriate for such design.

While most of these garments address the issue of appropriate storage, the converted bag closures are limited by the use of zippers or snap-like fasteners. This provides no other alternative to provide a fast and efficient bag closure. The use of additional fastening hardware not only adds to the cost of constructing the garment, it further increases bulkiness and discomfort when the item is in garment form. Additionally, proposed inventions like Ezell's Jac Pac lacks a closure all together thus providing no option to safely store items within an efficiently closed compartment.

Most convertible garments use a belt as the strap for carrying means further limiting the invention to only garments that have a belt. Such garments cannot be functionally converted to a carrying article unless the belt is always incorporated into the design. In an attempt to address this issue, Harris discloses a garment that uses the sleeves as a method for carrying the converted bag on one's shoulder. Nevertheless, this limits the invention to only garments that have longer sleeves and provides no alternatives for strap adjustment or removability.

SUMMARY

In accordance with one embodiment an outer garment convertible to shoulder bag comprises two separating zippers each connected to each side area of the garment in an open fashion wherein the bottom zipper portions of each separating zipper extend at approximately below the waist area and the top zipper portions of each separating zipper extend above the waist area starting at each side area of the garment. The top zipper portions further extend onto the garment upper back and end underneath an upper back panel. The upper back panel is positioned such that it replicates the shape of the garment's upper back and further connects to the garment at the neckline, shoulders, armholes and upper side areas of the garment. Underneath the upper back panel, a reinforcement strap of flexible material extends horizontally on top of the garment upper back between the two back armholes on each side. A set of D-rings are positioned at approximately each end of the reinforcement strap adjacent to the back armholes. The D-rings are further connected to the reinforcement strap both being reinforced between the garment upper back and upper back panel with a horizontal stitch. A removable bag strap is housed by loops connected to the inside of the garment's back portion along the waist area. The hem is elongated and the bottom zipper portions end at distance up from the garment's hem such that it creates an option for using the garment's bottom portion as a bag closing flap when the garment is converted to bag.

Advantages

The present disclosure provides a garment with hidden hardware that does not give the indication that it can be converted to a fully functional bag. The body of the garment is used to form the bag compartment such that when the garment is fully converted, it offers enough space and durability to be used efficiently as a bag. The addition of a back panel provides a device for hiding additional conversion hardware allowing for a classic outerwear style. The addition of a stitch applied horizontally on top of the upper back panel through the garment's upper back and through conversion elements like the D-rings and reinforcement strap, allows the panel to be flipped over the garment's neckline, shoulders and armholes to enclose them thus forming a straight bag opening edge. The present disclosure further uses the bottom of the garment to provide an easy and efficient bag closure without the need for additional hardware. It provides an aesthetically pleasing bag design with a removable bag strap located on the inside of the garment that can be removed without affecting the structure, design or aesthetics of the garment. The present disclosures also introduces a method of turning the sleeves inside the garment and fastening the front closure such as to create a smooth surface on the inner compartment of the bag.

DRAWINGS—FIGURES

In the drawings, closely related figures have the same number but different alphabetic suffixes.

Figure 1A:
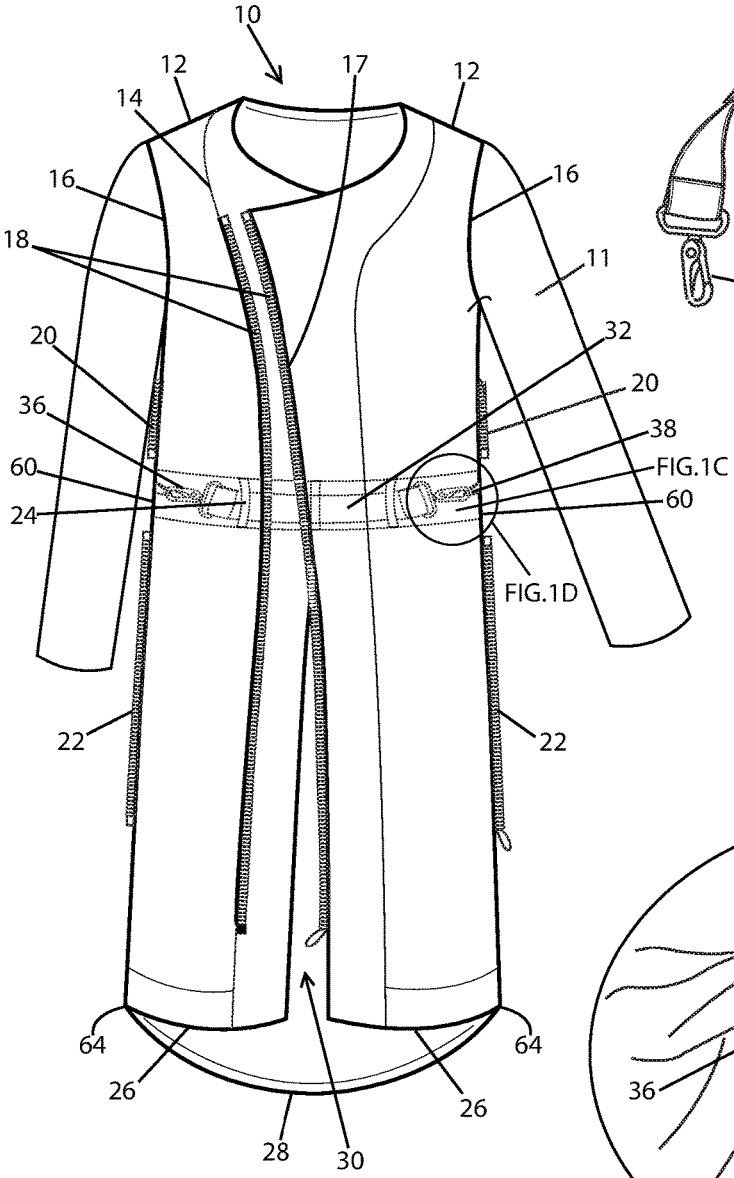
FIG. 1A illustrates the front view of the garment in conventional form.
Figure 1B:
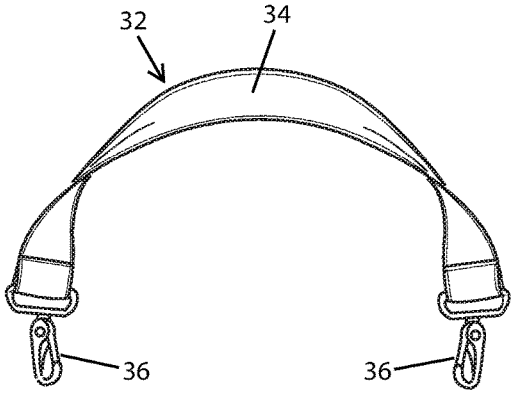
FIG. 1B illustrates the removable bag strap when separated from the inside of the garment.

| Drawings-Reference Numerals | |
|---|---|
| 10 | garment |
| 18 | front zipper closure |
| 17 | garment opening edge |
| 14 | vertical front seam |
| 11 | sleeves |
| 12 | shoulder seams |
| 16 | front armhole |
| 17 | front opening edge |
| 20 | top side zipper portions |
| 22 | bottom side zipper portions |
| 32 | removable bag strap |
| 34 | flexible strap |
| 36 | hook Closures |
| 24 | vertical loops |
| 38 | horizontal side loops |
| 40 | loop reinforcement panel |
| 26 | front hem |
| 28 | back hem |
| 30 | inside of garment back portion |
| 50 | bottom edge of upper back panel |
| 46 | back panel reinforcement stitch |
| 44 | back armhole |
| 54 | vertical upper back seam |
| 52 | garment upper back |
| 62 | garment lower back portion |
| 58 | back waist area |
| 60 | side waist area |
| 50 | loop reinforcement panel stitches |
| 56 | garment side seam |
| 64 | side Hem |
| 74 | hidden view of vertical upper back seam |
| 72 | hidden view of top side zipper portion |
| 70 | D-ring attachment |
| 68 | reinforcement strap |
| 66 | D-rings |
| 46 | back panel horizontal stitch |
| 76 | bag opening edge |
| 78 | bag side areas |
| 80 | bag closing flap |
| 48 | upper back panel |
| 42 | neckline |

DETAILED DESCRIPTION OF SOME PREFERRED EMBODIMENTS—FIG. 1A, FIG. 1B, FIG. 1C, FIG. 1D, FIG. 2A, FIG. 2B

Referring to FIG. 1A, the garment is constructed in a conventional way consisting of a front zipper closure 18 positioned on the front of garment 10. Front zipper closure 18 suggested herein is a separating zipper with one of its two mating zipper portions positioned along the garment front opening edge 17 while the other is fastened into a vertical front seam 14 on the opposite side on the front of garment 10. The positioning of front zipper closure 18 is not critical to the invention as it may be positioned centrally on the garment's front or off-center as suggested in the present disclosure. The use of a separating zipper as the garment's closure is also not critical to the invention as other alternative garment closures such as snaps, buttons or hook-and-loop tape may be used as chosen by the designer. However, for best results in the convertibility of the present disclosure, garment 10 should be provided with appropriate means to keep its front portion closed when it is converted to bag.

A depiction of dash lines illustrated in FIG. 1A shows the hidden removable bag strap 32 being inserted through vertical loops 24 and further connected to horizontal side loops 38 with the help of two hook closures 36. An illustration of removable bag strap 32 when separated from garment 10 is further displayed in FIG. 1B. As displayed in FIG. 1B, removable bag strap 32 consists of a flexible strap 34 wherein each hook closure 36 is connected to its ends.

Figure 1C:
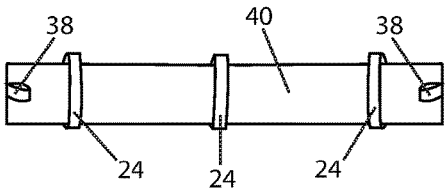
FIG. 1C illustrates a detail view of the loop reinforcement panel featuring multiple loops used for housing the removable bag strap.
Figure 1D:
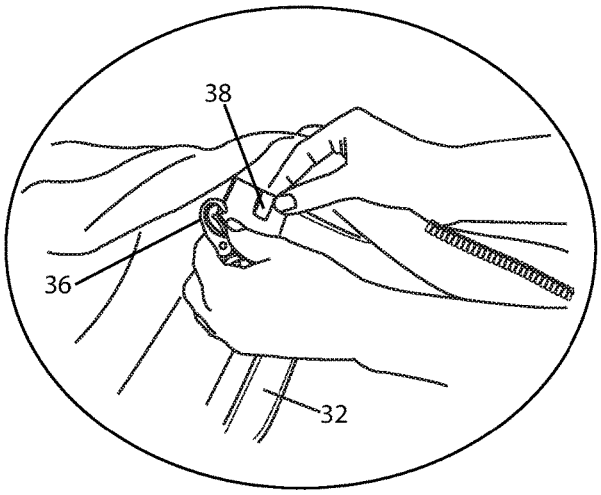
FIG. 1D illustrates a detailed operational view of one of the removable bag strap's hook closures in relation to one of the side loops located on the loop reinforcement panel which is connected to the inner side waist area of the garment.

Additionally, FIG. 1D illustrates a close up view of one of the hook closures 36 of removable bag strap 32 in relation to one of the horizontal side loops 38 housed on the inside of garment 10.

As is further depicted in FIG. 1C, vertical loops 24 and horizontal side loops 38 are connected to a loop reinforcement panel 40 made of flexible material which is then permanently attached horizontally to the inside of garment back portion 30 (FIG. 1A) at approximately the waist area. While loops serve as a preferred method for housing the removable bag strap 32 on the inside of garment 10 in the present embodiment, reinforcement loop panel 40 alone is not critical to the functionality of the invention as the loops may stand alone. However, loop reinforcement panel 40 is suggested as a contributing factor in the durability of the garment and helps in further stabilizing removable bag strap 32 when it is housed on the inside of garment back portion 30. The size and material of vertical loops 24 and horizontal side loops 38 may be of any length and type as considered by the designer as long as removable bag strap 32 can easily fit through and be durably housed within each loop opening. Additionally, hook closures 36 may be of any style or material desired as long as they can be efficiently attached to horizontal side loops 38 and the later-described D-rings 66 (FIG. 2B) in a removable style being durable enough to withstand the converted bag at its full weight capacity.

Figure 8:
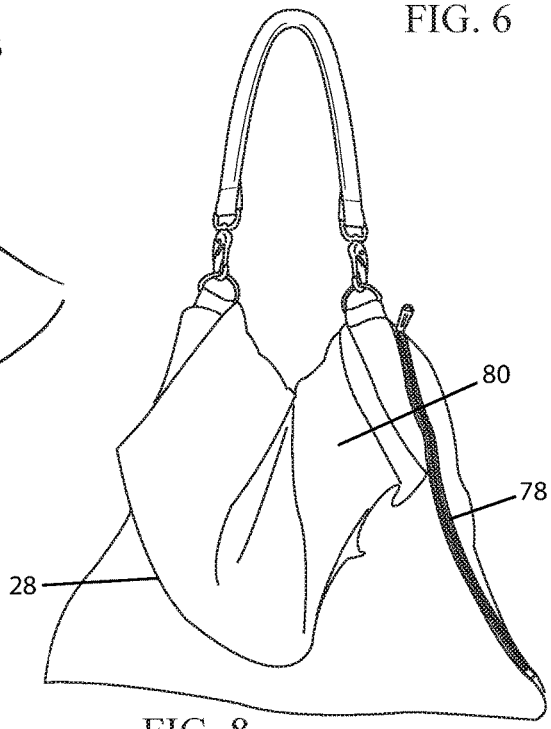
FIG. 8 illustrates the bag in its final converted form.

Also referring to FIG. 1A, garment 10 consists of a front hem 26 and a back hem 28. In one embodiment, it is suggested that back hem 28 is elongated such that when garment 10 is converted to a bag, front hem 26 is hidden by the elongated back hem 28 to form a clean, single edge for bag closing flap 80 (FIG. 8). As suggested by the present disclosure, back hem 28 is elongated in a curved fashion. However, any style considered by the designer is acceptable as long as back hem 28 is longer than front hem 26.

Further displayed in FIG. 1A are two separating zippers each extending in an open fashion along each side of garment 10. Each bottom zipper portion 22 of each separating zipper extends along each side area of garment 10 starting at approximately below side waist area 60 and ending at a distance of at least 2" up from side hem 64. Each top zipper portion 20 of each separating zipper extends from approximately above side waist area 60 of garment 10 starting along the garment's side and ending on garment upper back 52 (FIG. 2A) underneath an upper back panel 48 which is further discussed in FIG. 2A.

Figure 2A:
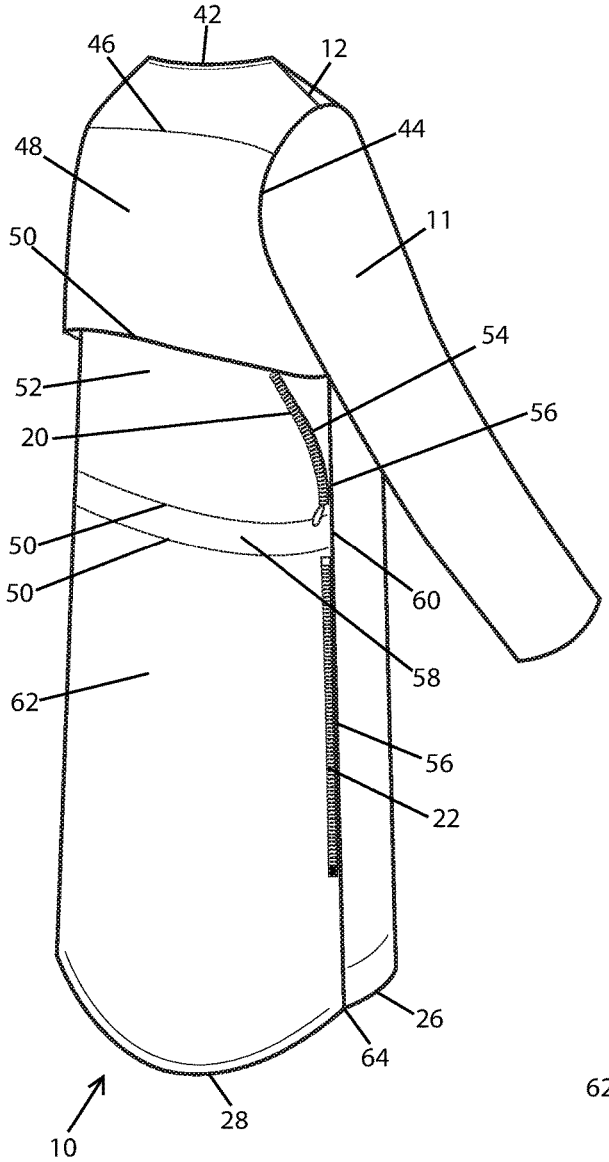
FIG. 2A illustrates a three-quarter back view of the garment as it appears to the naked eye.
Figure 7:
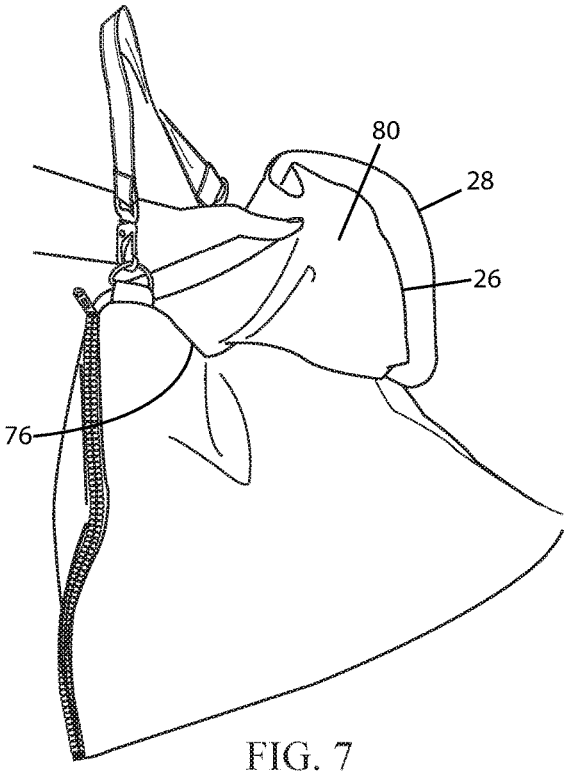
FIG. 7 shows one bringing the bottom of the garment over the bag opening to form the bag's flap closure.

FIG. 2A discloses a three-quarter view of the back of garment 10 as it appears to the naked eye. Illustrated in FIG. 2A is a top zipper portion 20 and a bottom zipper portion 22 of one of the side separating zippers. Although the three-quarter view in FIG. 2A displays the elements and alignment of just one of the side separating zippers, it is important to note that both separating zippers are identically positioned on each side of garment 10. The bottom zipper portions 22 extend vertically along each garment side seam 56 starting bellow each side waist area 60 and ending at a distance of at least 3" up from each side hem 64. The distance between the lower end of the bottom zipper portions 22 and the garment side hem 64 needs to allow for enough excess to form a functional bag closing flap 80 (FIG. 8) in the final bag conversion. Suggested in the present disclosure is that bottom zipper portions 22 are reinforced into the garment side seams 56 for less visibility. This however is not critical to the invention as bottom zipper portions 22 may be reinforced to the surface of the garment or by other reinforcement means as considered by the designer. It is however critical to the full convertibility of the garment that both bottom zipper portion 22 on each side of garment 10 be placed vertically below the waist area of garment 10 somewhat adjacent to the garment side seam 56 and end at enough distance up from side hem 64 to create bag closing flap 80 (FIG. 7)

Each top zipper portion 20 of each side separating zipper extends from approximately above side waist area 60 starting at each garment side seam 56 and further extending into a vertical upper back seam 54 on each side. As top zipper portions 20 and vertical upper back seams 54 reach underneath upper back panel 48, they are no longer visible to the naked eye.

Further displayed in FIG. 2A, upper back panel 48 is a separate layer of flexible material, preferably constructed of the same fabric as garment 10 and connected to garment 10 at neckline 42, shoulder seams 12, back armholes 44 and the uppermost area of garment side seams 56. The bottom edge of upper back panel 50 is free standing and not connected to garment upper back 52. Upper back panel 48 takes the shape of the top portion of garment upper back 52. A back panel horizontal stitch 46 is visible on the outside of upper back panel 48 and extends horizontally between the two back armholes 44. Back panel horizontal stitch 46 extends longitudinally on the top area of upper back panel 48 at a short distance down from neckline 42 and shoulder seams 12.

Upper back panel 48 serves as a device to hide the conversion hardware thus conveying the look of a conventional outer garment with no indication that it may be transformed into a bag. For the same purpose, it is suggested in the preferred embodiment that the color of the side separating zippers on each side be similar to that of garment 10 such as to blend in with garment side seams 56 more efficiently. However, the reinforcement means, style and color of the side separating zippers are not critical to the convertibility of the present disclosure as long as they follow a similar open alignment described herein and can be efficiently closed and opened in a separating fashion.

Further referring to FIG. 2A, two loop reinforcement panel stitches 50 are applied horizontally along back waist area 58 between the two side waist areas 60 of garment 10. Loop reinforcement panel stitches 50 are used as a method to connect loop reinforcement panel 40 (FIG. 1C) to the inside of garment back portion 30 (FIG. 1A) and visible on both the outside and inside of garment 10. Any stitch style that is efficient enough to permanently connect loop reinforcement panel 40 (FIG. 1C) to inside of garment's back portion 30 (FIG. 1A) may be used as considered by the designer.

Figure 2B:
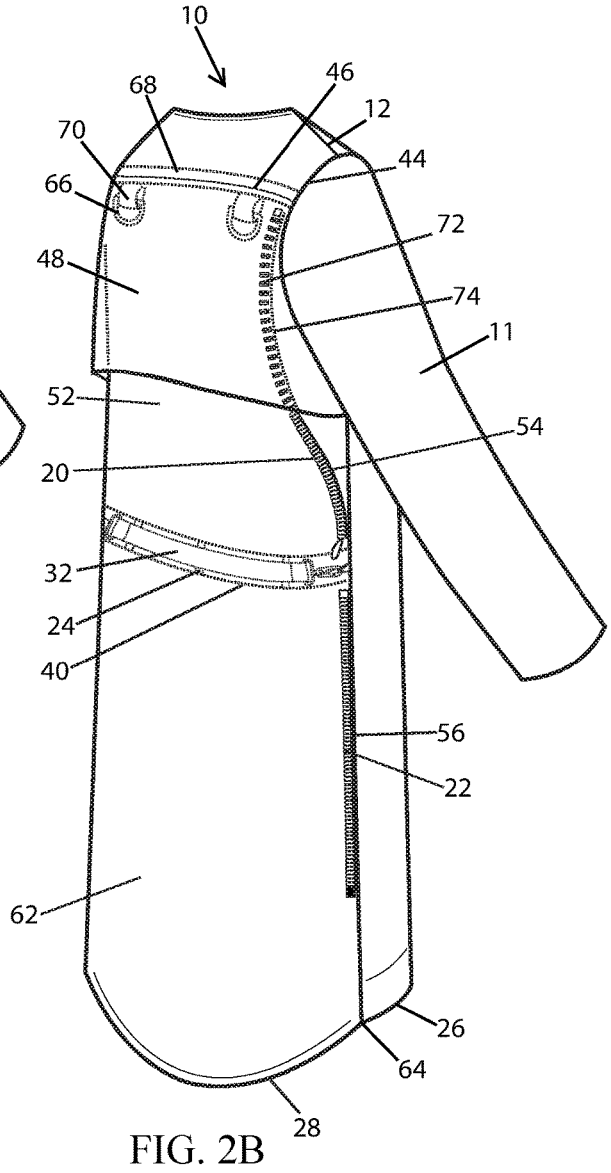
FIG. 2B is the same three-quarter back view of the garment as FIG. 2A but additionally illustrating the garment's hidden elements displayed by dashed lines.

FIG. 2B shows a three-quarter back view of garment 10 further illustrating hidden elements not visible to the naked eye marked by dash lines. Similar to FIG. 2A, only one side of garment 10 is visible in the three-quarter view presented herein. However, it is to be noted that the two sides of garment 10 are identical even though both sides are not simultaneously displayed in FIGS. 2A and 2B. As displayed in the figure, one of the top zipper portions 20 which is reinforced into one of the vertical upper back seams 54, extends under upper back panel 48 and ends along one of the back armholes 44 at a short distance down from one of the shoulder seams 12. As further illustrated in FIG. 2B, top zipper portion 20 and vertical upper back seam 54 become hidden to the naked eye as they extend underneath upper back panel 48. Hidden view of top zipper portion 72 and hidden view of vertical upper back seam 74 ending along back armhole 44 are further illustrated in FIG. 2B. As previously noted, vertical upper back seams 54 extending on each side of the back of garment 10 are a recommended suggestion for reinforcing each top zipper portion 20. However, top zipper portions 20 may be reinforced on the surface of garment upper back 52 without the need for additional seams as long as the alignment follows a similar placement disclosed herein.

Also referring to FIG. 2B, underneath upper back panel 48 are two D-rings 66 each located at approximately where each top zipper portion 20 ends along each back armhole 44. b-rings 66 are connected to garment upper back 52 in a horizontal alignment with the help of two D-ring attachments 70. In the present disclosure, each D-ring attachment 70 is formed by a durable fabric strip inserted through each D-ring 66 and further reinforced between garment upper back 52 and upper back panel 48 with stitching. It is not critical to the disclosure described herein that D-rings are used exclusively. Other types of devices, flexible or non-flexible composition, or any closed hardware may be used as long as they can be connected to hook closures 36 (FIG. 1B) of removable back strap 32 (FIG. 1B) and withstand the weight of the bag when garment 10 is in converted form. It is however important to the convertibility of the garment that any hardware used to replace D-rings 66, whether attached by fabric strips or other means, be positioned horizontally across the face side of garment upper back 52 somewhat adjacent to the end of each top zipper portion 20 adjacent to each back armhole 44. In addition, any such hardware must be placed under upper back panel 48 on top of the face side of garment upper back 52 such that it is invisible to the naked eye both on the inside and outside of garment 10. D-rings 66 or any substitute hardware should be accessible from underneath upper back panel 48 by lifting upper back panel edge 50.

Also referring to FIG. 2B, a 1" to 2" wide reinforcement strap 68 is positioned horizontally between back armholes 44 overlapping or underneath D-ring attachments 70 and further positioned underneath upper back panel 48. The reinforcement strap 68 is permanently connected between the face of garment upper back 52 and upper back panel 48 with permanent stitching. In the present disclosure, reinforcement strap 68 is a poly/nylon webbing but other options of durable flexible material may be used as considered by the designer. The purpose of reinforcement strap 68 is to reinforce and stabilize D-rings 66 positioned along bag opening edge 76 (FIG. 4C) contributing to the efficiency and long-term durability of the converted bag. Just like D-rings 66 and D-ring reinforcements 70, reinforcement strap 68 is sandwiched between upper back panel 48 and face of garment upper back 52 such that it is not visible on the inside or outside of garment 10.

Further referring to FIG. 2B, a critical back panel reinforcement stitch 46 is applied horizontally on top of upper back panel 48 between both back armholes 44 catching all layers of reinforcement strap 68, D-rings 66, D-ring attachments 70 and garment upper back 52 underneath. Back panel reinforcement stitch 46 is visible on both the outside of upper back panel 48 and inside of garment upper back 52. Back panel reinforcement stitch 46 is critical in the coverability of garment 10 as it eventually allows for the formation of a straight bag opening edge 76 (FIG. 4C, FIG. 7) at the opening of the converted bag, and facilitates a hidden enclosure of neckline 42, shoulders 12 and the armhole openings.

Further displayed in FIG. 2B by dash lines is a hidden view of removable bag strap 32 and loop reinforcement panel 40 which are connected to the inside of garment back portion 30 (FIG. 1A) at approximately back waist area. Loop reinforcement panel 40 (FIG. 1C) is positioned between the lower end of top zipper portions 20 and upper end of bottom zipper portions 22 extending horizontally from one of the side waist areas 60 (FIG. 2A) to the other. Its location serves as a visual guideline when folding garment 10 in the conversion process further disclosed in the description of the operation steps to follow.

Operation—FIG. 3, FIG. 4A, FIG. 4B, FIG. 4C, FIG. 5, FIG. 6, FIG. 7, FIG. 8

Figure 3:
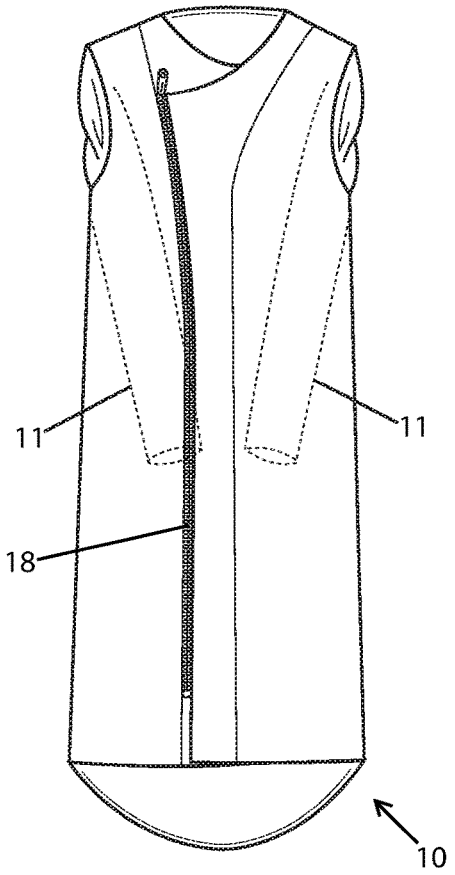
FIG. 3 shows the first operational step towards conversion to bag by zipping the front zipper closure and pulling the sleeves inside the garment.

Assuming removable bag strap 32 has been separated from inside garment 10 by releasing hook closures 36, the first step in the conversion process is illustrated in FIG. 3 by the insertion of the two sleeves 11 towards the inside of garment 10. Once sleeves 11 are turned inside out and positioned on the inside of garment 10, front zipper closure 18 is fully closed. The method described herein hides sleeves 11 on the inside of garment 10 such as to make them invisible in the final bag conversion.

Figure 4A:
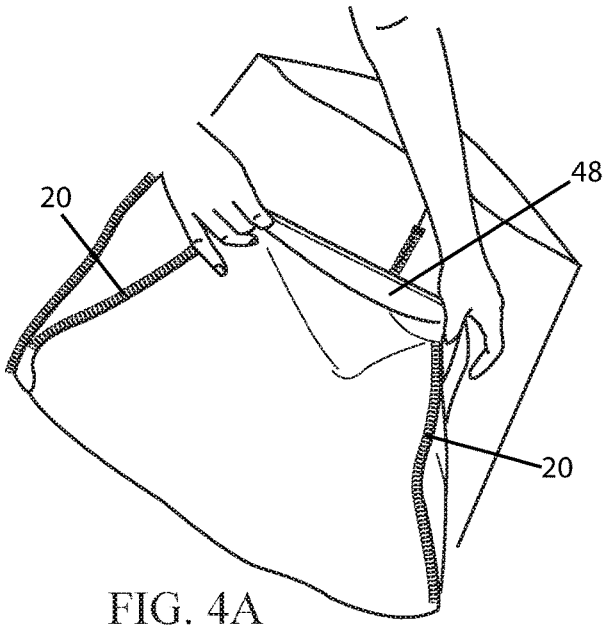
FIG. 4A shows the next operational step in the conversion process by reaching behind the upper back panel.

Further in the operational steps of the present disclosure, FIG. 4A illustrates a back view of garment 10 as one reaches underneath upper back panel 48. Lifting upper back panel 48 further exposes top zipper portions 20 located on both sides of garment 10.

Figure 4B:
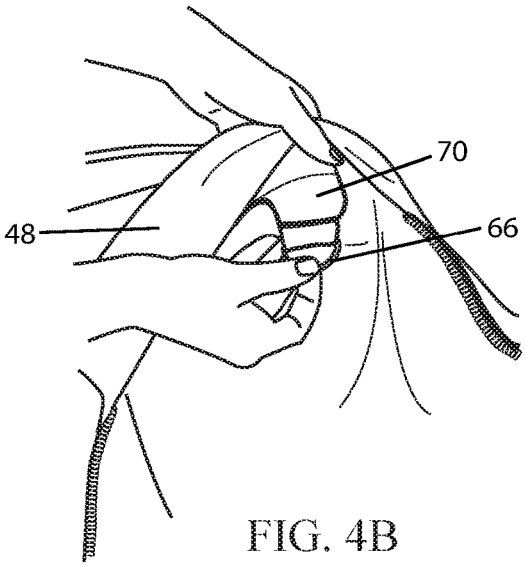
FIG. 4B shows a partial view of the garment as one reaches and pulls on the side D-rings enclosed under the upper back panel.

As further displayed in FIG. 4B, the user grabs one of the D-rings 66 housed underneath upper back panel 48. As D-rings 66 become more visible, so do D-ring attachments 70.

Figure 4C:
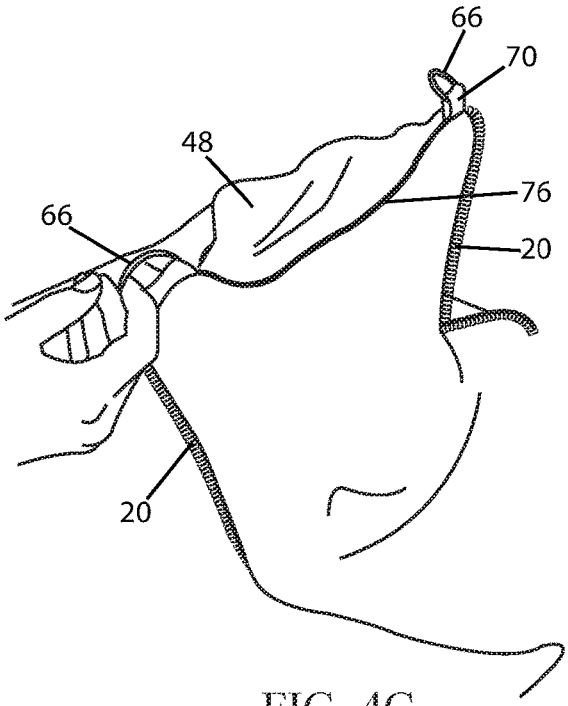
FIG. 4C shows a partial view of the garment as the upper back panel is completely repositioned over the uppermost area of the garment thus enclosing it to expose a new edge containing two D-rings and zipper ends located at each corner along the formed edge.

In FIG. 4C, both D-rings 66 and D-ring attachments 70 become completely exposed by one pulling them towards the outside. Pulling D-rings 66 outwards results in upper back panel 48 flipping over neckline 42 (FIGS. 2A, 2B), shoulder seams 12 (FIGS. 1A, 2A), front armholes 16 (FIG. 1A) and back armholes 44 (FIG. 2A) thus hiding all of them underneath. Once upper back panel 48 is completely flipped over, the ends of each top zipper portions 20 are exposed. Back panel reinforcement stitch 46 (FIG. 2A) applied horizontally through all layers of the garment's upper back allows for the formation of a straight bag opening edge 76. Bag opening edge 76 houses D-rings 66 and D-ring attachments 70 being further reinforced for durability by the addition of reinforcement strap 68 (FIG. 2B) visible along the edge. In the present disclosure, only the edge of reinforcement strap 68 is visible along bag opening edge 76. However, more of its surface may be positioned to be more visually exposed as considered by the designer. Bag opening edge 76 further contributes to the preferred functional operation of the converted bag.

Figure 5:
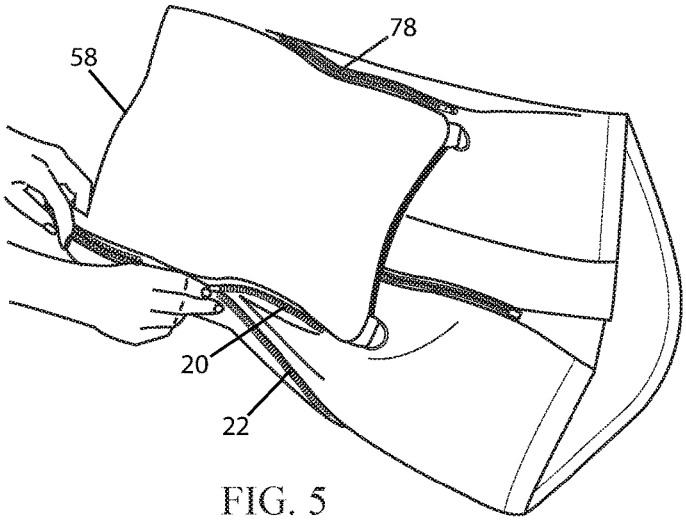
FIG. 5 shows the bottom zipper portions of the two side separating zippers being connected to each of their corresponding top zipper portions starting at the waist area up.

Once upper back panel 48 has been completely flipped over to the front of garment 10, FIG. 5 displays the next operational step in the conversion process by folding garment 10 horizontally along back waist area 58 such that front closure 18 is on the inside of the fold. Folding the garment aligns top zipper portions 20 to their mating bottom zipper portions 22 thus allowing them to be closed starting at the waist area up. The newly closed side separating zippers on each side of garment 10 form bag side areas 78. Completing this step creates the bag container.

Figure 6:
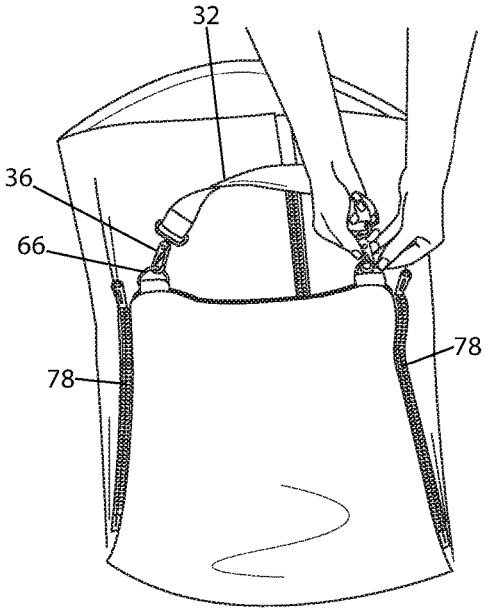
FIG. 6 shows each hook closure of the removable bag strap being attached to its corresponding D-ring.

As displayed in FIG. 6, removable bag strap 32 is then connected to the converted bag by attaching each hook closure 36 to each corresponding D-ring 66.

As a final conversion step, FIG. 7 illustrates the user pulling the bottom of garment 10 over bag opening edge 76 to form a bag closing flap 80. The elongated back hem 28 overlaps the shorter front hem 26 thus hiding it underneath for a clean-finished flap edge. Bag closing flap 80 serves as a functional device to open and close the bag container.

As a result of the operational steps described herein, FIG. 8 illustrates a semi three-quarter view of the converted bag.

Bag opening edge 76 (FIG. 7) is enclosed by bag closing flap 80 as a preferred option to efficiently close the bag compartment. The two bag side areas 78 are comprised of closed top zipper portions 20 and bottom zipper portions 22 on each side. Back hem 28 now forms the curved bottom edge of bag closing flap 80. Front hem 26 (FIG. 7) is not visible on the outside of the converted bag due to the elongated nature of back hem 28 overlapping it.

ALTERNATIVE AND ADDITIONAL EMBODIMENTS

Some alternative embodiments involve zippers being connected by various methods or styles of stitching either within a seam or on the surface of the garment. The front zipper and side separating zippers may be replaced by any device that achieves similar results. Some examples include: hook-and-loop tape, snaps, buttons and hook and eyes. Any alternative closures should operate such that when the garment is folded about the waist area, its top and bottom sides can be connected to form the bag container. In addition, the front closure may be positioned anywhere on the front as long as it keeps the garment closed effectively. However, it is not critical to the convertibility of the garment that it has a front opening all together and the garment may be designed in pullover style. Additionally, the garment can operate with sleeves of any length or have no sleeves at all. Therefore, the inclusion of sleeves is not critical to the convertibility of the garment. The garment may be constructed of any flexible material or combination, from light to heavy weight, as long as it can withstand the wear and use of the garment and converted bag respectively.

The garment does not require a reinforcement loop panel and the loops can therefore be connected to the garment separately. The loops can be made of any material as considered by the designer, as long as they can house the removable bag strap accordingly. In addition, the removable bag strap can be placed on the inside or the outside of the garment, above or below the waist area as desired. Additionally, it can be held in place by only the side loops without the use of vertical loops. The D-rings housed under the upper back panel may be replaced by any other suitable hardware or composition that forms a sealed device for attaching the removable bag strap. This device, hardware or composition can be made of any material, flexible or non-flexible, as long as it is durable enough to withstand the weight of the converted bag at its full capacity. Respectively, the hook closures located on each end of the removable bag strap can be replaced by any type or style of hardware as long as it can be removably attached and withstand the converted bag at its full capacity. Some additional embodiments involve the bottom of the garment having an even hem that is not elongated, the upper back panel being longer or shorter, and the removable strap being made of any material and any width that can operate as a shoulder bag strap.

Accordingly, the reader will see that some embodiments described herein create a more wearable and functional convertible garment. The addition of the back panel to hide the conversion hardware blends in with the style of the outer garment thus giving no indication that the garment is of the convertible nature. The horizontal stitch applied through all layers of the upper back allows the back panel to form an authentic bag opening edge when brought over the front of the garment in the conversion process. The upper back panel hides key elements of the garment when it is in converted bag form thus increasing the functionality of the bag. The side separating zippers are placed such as to form fully functional, sealed sides for the shoulder bag. Additionally, the embodiments described herein use the entire body of the garment as the bag container efficiently. The elongated hem and the positioning of the side bottom zipper portions allow for the formation of a bag closing flap which not only contributes to the bag aesthetically, but it also creates an easy option for closing the bag compartment. The bag strap is housed on the inside of the garment and may be removed as desired without jeopardizing the style, design or structure of the outer garment.

While my above description contains many specificities, these should not be considered limitations on the scope or design, but rather serve as examples of one (or several) embodiments. Other variations are possible as described above.

I claim:

1. A garment arranged to be convertible to a shoulder bag comprising:

a garment having at least a front portion and a back portion including a garment upper back, said front portion and said back portion defining shoulders, neckline, armholes, bottom, two side areas and a waist area wherein said waist area is positioned longitudinally between said side areas;

two separating zippers each connected to respective side areas of said garment in an open fashion wherein bottom zipper portions of each said two separating zippers extend below said waist area along said side areas and top zipper portions of each said two separating zippers extend above said waist area starting at each said side area and further extending onto the garment upper back and ending underneath an upper back panel;

said upper back panel positioned such that it replicates the shape of said garment upper back and connects to it at said neckline, said shoulders, said armholes and said side areas by means of reinforcement;

a reinforcement strap of flexible material extending horizontally on top of said garment upper back underneath said upper back panel between said armholes on each of said sides;

D-rings positioned at approximately each end of said reinforcement strap adjacent to said armholes and ends of said top zipper portions and further connected to said garment upper back, said reinforcement strap and said upper back panel with a back panel horizontal stitch.

2. A garment according to claim 1 wherein said bottom zipper portions terminate a distance from a side hem such as to allow a bottom of said garment to form a bag closing flap.

3. A garment according to claim 1 wherein said back panel horizontal stitch is applied longitudinally through said upper back panel, said reinforcement strap, said D-rings and said garment upper back so as to allow for a straight bag opening edge when said upper back panel is flipped towards said front portion of said garment.

4. A garment according to claim 3 wherein said D-rings and a longitudinal edge of said reinforcement strap are positioned sp as to be exposed when said upper back panel is flipped over said front portion of said garment.

5. A garment according to claim 3 wherein said D-rings are located adjacent to each end of said straight bag opening edge.

6. A garment according to claim 1 wherein said top zipper portions end at approximately mid-way along said armholes underneath said upper back panel so as to allow said bottom zipper portions and said top zipper portions to close when said garment is folded along said waist area to form a bag compartment.

7. A garment according to claim 1 wherein a bottom of said garment is elongated to create means to close the bag.

8. A garment according to claim 7, wherein said bottom of said garment comprises a back hem corresponding to said back portion and a front hem corresponding to said front portion of said garment wherein said back hem is elongated so as to allow for hiding said front hem underneath when said bottom extends over a bag opening.

9. A garment according to claim 1, wherein said waist area comprises vertical loops and horizontal side loops so as to allow for holding a removable bag strap in a horizontal position between said side areas of said garment at approximately said waist area.

10. A garment according to claim 9 wherein said vertical loops and said horizontal side loops are connected to a loop reinforcement panel further connected to inside of said garment longitudinally along said waist area.

11. A garment according to claim 9 wherein said removable bag strap has a hook closure on each end so as to allow attachment to each said D-ring on said upper back area of said garment.

12. A garment according to claim 9, wherein said removable bag strap is approximately the same length as the longitudinal distance between said side areas of said back portion of said garment at approximately said waist area.

13. A method of converting a garment having at least a front portion to a converted bag form and a back portion comprising the steps of:

providing a garment comprising a waist area, armholes, shoulders, neckline opening, two side areas, bottom, garment upper back, a pair of sleeves, a front closure, a pair of separating zippers along each side area of said garment, an upper back panel, D-rings and a reinforcement strap permanently connected between the upper back panel and garment upper back by a horizontal back panel stitch, a removable bag strap with hook closures housed within loops on the inside of the garment, and an elongated hem;

pulling the removable bag strap from inside the garment by releasing the hook closures from the loops located on the inside of the garment;

positioning the sleeves inside the garment for containment when the garment is in converted bag form;

closing the front of the garment fully by fastening the front closure;

reaching underneath the upper back panel and pulling the D-rings to expose them which further flips the upper back panel towards the front of the garment covering the neckline opening, shoulders, and armholes to create a bag opening edge;

folding the garment longitudinally about the waist area with the front closure positioned on the inside of the fold;

locating the bottom and top zipper portions of each separating zipper along each side of the garment and closing each separating zipper from the waist area up to form the bag compartment and bag opening;

attaching the hook closures of the removable bag strap to the D-rings positioned adjacent to each end of the bag opening edge;

bringing the bottom of the garment comprising the elongated hem over the bag opening to form a bag closing flap to provide a device for closing the bag.

* * * * *